US006598625B2

(12) United States Patent
Allison

(10) Patent No.: US 6,598,625 B2
(45) Date of Patent: Jul. 29, 2003

(54) INTERNAL PRINTER INK TANK ADAPTED FOR BETTER SPACE EFFICIENCY

(75) Inventor: Michael J. Allison, Brush Prairie, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/000,251

(22) Filed: Oct. 29, 2001

(65) Prior Publication Data

US 2003/0079795 A1 May 1, 2003

(51) Int. Cl.[7] ..... B65B 1/04
(52) U.S. Cl. ..... 141/2; 141/18; 347/85
(58) Field of Search ..... 141/2, 18, 100, 141/104, 98, 67; 347/85–87

(56) References Cited

U.S. PATENT DOCUMENTS 5,732,751 A * 3/1998 Schmidt et al. ..... 141/48
5,934,344 A * 8/1999 Wainberg et al. ..... 141/83
6,360,795 B1 * 3/2002 Bothe et al. ..... 141/346

* cited by examiner

*Primary Examiner*—Steven O. Douglas

(57) ABSTRACT

An implementation of a printer ink delivery system and method for increasing the efficiency of space utilization within a printer includes at least one available-space-conforming internal ink tank adapted to fit within difficult to access areas within a printer's enclosure. A fill port allows the temporary attachment of an externally located, ergonomically shaped ink refill canister. By utilizing space which otherwise might go unused for placement of the internal ink tank, a smaller printer enclosure may be designed. By providing a fill port adapted for attachment of ergonomic ink refill canister, the user is easily able to refill the internal ink tank.

19 Claims, 4 Drawing Sheets

INTERNAL PRINTER INK TANK ADAPTED FOR BETTER SPACE EFFICIENCY

TECHNICAL FIELD

This disclosure relates to an ink delivery system and method to more efficiently manage space within a printer's enclosure by using an internal ink tank adapted to conform to difficult to access locations within a printer's enclosure.

BACKGROUND

It is common to integrate printhead nozzle functionality with a container of ink. Using such a system, the ink s moves with the printhead during the printing process. This process works reasonably well in most home and office environments. However, in some applications and at some duty cycles, the volume of ink contained simply insufficient; as a result, the printhead must be replaced frequently. A related problem is that the ink is usually gone before the printhead mechanism has worn out. As a result, the user is periodically throwing out an otherwise viable printhead mechanism.

To support a duty cycle wherein a greater supply of ink is required, a replaceable ink container that is separate from the printhead may be used. Such replacement ink containers are located within a portion of the printer that is easily accessed by office workers. During installation, a port in the printer is opened, the depleted ink container is removed, and the replacement container installed. During the printing process, ink feeds out of the container and is moved, possibly by a pumping apparatus, to the printhead through a tube. Such a system is advantageous because of the ease by which an old ink container may be removed and a replacement container installed. Additionally, the printhead mechanism is not replaced until failure occurs or is predicted.

Unfortunately, a disadvantage of the above ink container replacement system is that the design of the overall printer is constrained by the need to reserve space for the ink containers in a location that is easily accessible. Additionally, because of the need to make the ink containers ergonomically attractive to consumers, the space allocated to such ink containers is typically greater than the volume of the ink contained. As a result, the overall space utilization is inefficient.

SUMMARY

An implementation of a printer ink delivery system and method for increasing the efficiency of space utilization within a printer includes at least one available-space-conforming internal ink tank adapted to fit within difficult to access areas within a printer's enclosure. A fill port allows the temporary attachment of an externally located, ergonomically shaped ink refill canister. By utilizing space which otherwise might go unused for placement of the internal ink tank, a smaller and more ergonomic printer enclosure may be designed. By providing a fill port adapted for attachment of an ergonomic ink refill canister, the user is easily able to refill the internal ink tank.

BRIEF DESCRIPTION OF THE DRAWINGS

The same numbers are used throughout the drawings to reference like features and components.

FIG. 4 is a cross-sectional view of a printer, taken along the 4—4 lines of:

FIG. 1, showing three color internal ink tanks on the left and one black internal ink tank on the right. Double lines indicate that figure has been narrowed by removal of a middle portion for reasons of clarity and space.

DETAILED DESCRIPTION

An implementation of a printer ink delivery system and method for increasing the efficiency of space utilization within a printer includes at least one available-space-conforming internal ink tank adapted to fit within difficult to access areas within a printer's enclosure. A fill port allows the temporary attachment of an externally located, ergonomically shaped ink refill canister. By utilizing space which otherwise might go unused for placement of the internal ink tank, a smaller printer enclosure may be designed. By providing a fill port adapted for attachment of ergonomically shaped ink refill canister, the user is easily able to refill the internal ink tank.

Figure 1:
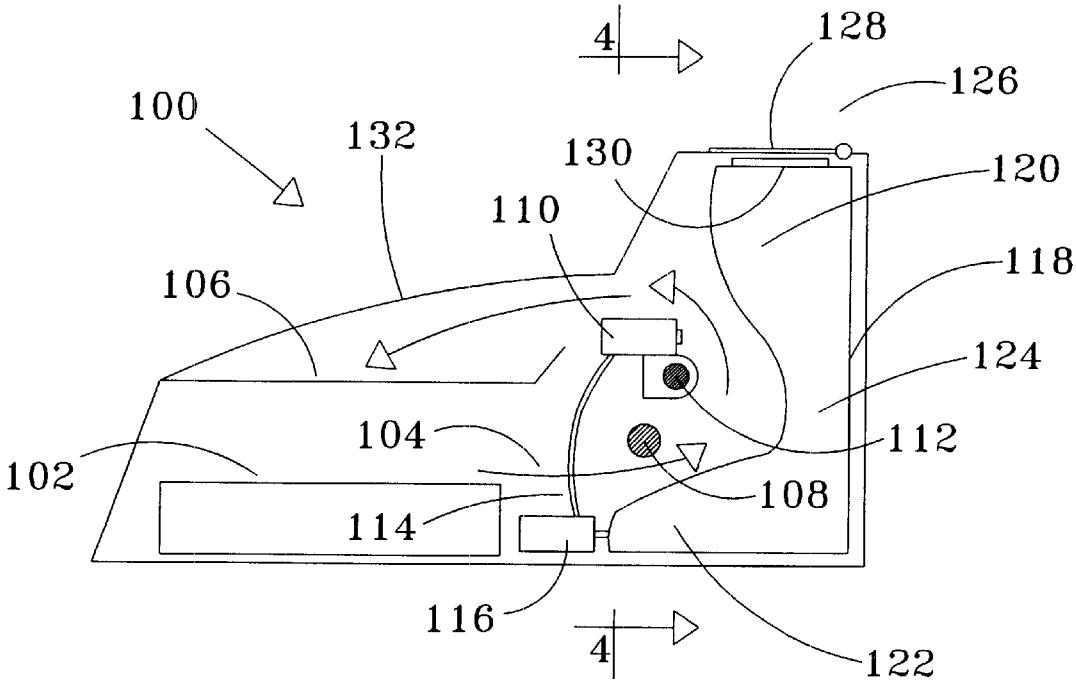
FIG. 1 is a side cross-sectional view of an exemplary printer, showing an internal ink tank associated with an ink delivery system for a printer.

FIG. 1 shows a cross-sectional view of an ink delivery system contained within an exemplary printer 100. In the course of a printing operation, paper moves from a sheet media tray 102, through a paper path 104, to an output tray 106. A feed roller 108 assists in moving and positioning the paper. A printhead or pen 110 travels on a carriage rod 112. Ink is delivered to the pen through a tube 114 by a pump 116, having a mechanical pumping action, gravity feed, capillary action or similar fluid-driving ability.

An internal ink tank 118 conforms to the available space not used by other printer components. In the exemplary printer 100, space exists in four primary locations: above-and-behind, below-and-behind and to both sides of the paper path. Accordingly, the internal ink tank includes upper and lower lobes 120, 122 that occupy these two of these locations. Each lobe therefore comprises all or part of the ink tank, and sized to fit within a desired location. In FIG. 1, the two lobes are connected by an isthmus 124, which allows ink to travel between the lobes as it is added and removed.

The multi-lobed shape of the internal ink tank maximizes the volume of ink that may be stored, given the constraints of the space available within the printer's enclosure 132. In the example of FIG. 1, the lower lobe 122 extends under the paper path, behind and below both the carriage rod 112 and the feed roller 108. Such a location is inaccessible through any conveniently located port that could be defined in the enclosure of the printer. Thus, no storage device that is conveniently removable could be made to utilize this location. However, because the internal ink tank 118 includes a lobe 122 which extends into this location, and because the internal ink tank does not require removal during the refilling process, the location wherein the lower lobe is located may therefore be utilized to contain ink.

The upper lobe 120 is adjacent to a fill port 126, which allows the; internal ink tank to be refilled, as needed. A black ink fill port hatch 128 is seen in the closed position. Beneath the black ink fill port hatch is an edge view of the black ink adapter valve or adapter lid 130, which allows connection to an ergonomically shaped ink refill canister, as will be seen in greater detail.

Figure 2:
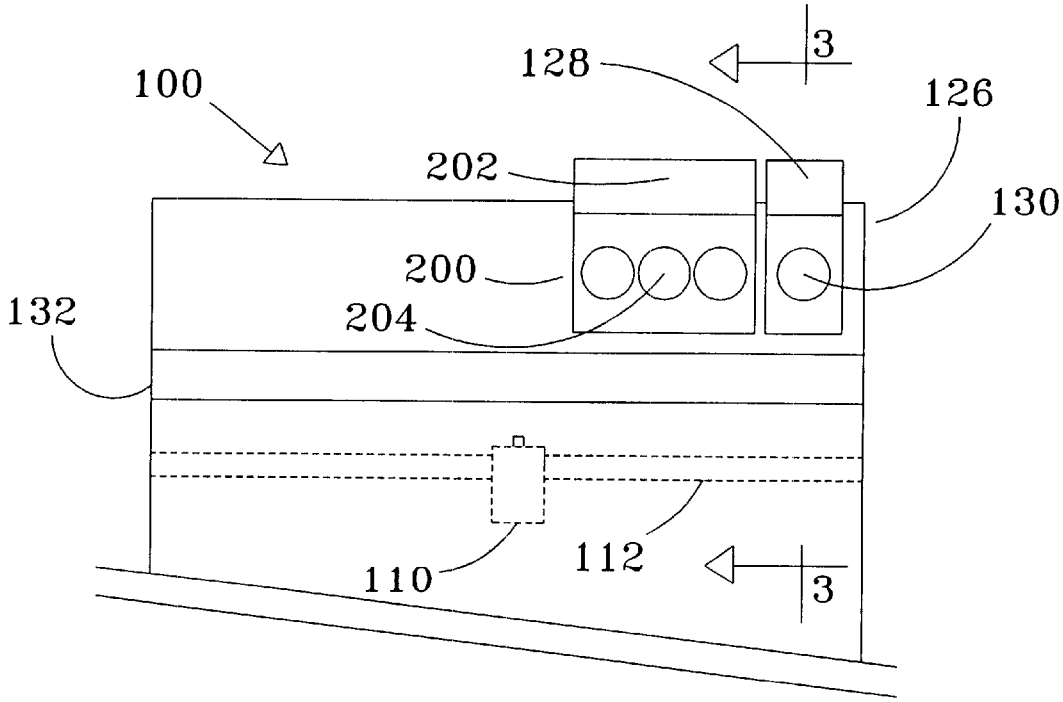
FIG. 2 is a top plan view of a rear portion of the printer, showing a color ink fill port and a black ink fill port. Double lines indicate that a front portion of the printer has been removed from the illustration for reasons of clarity and space.

FIG. 2 shows a top plan view of the printer 100. The printhead pen 110 and carriage rod 112 are shown to provide a frame of reference, and are in dotted outline to indicate that they are contained within an enclosure 132 of the printer. A color ink fill port 200 and the black ink fill port 126 are seen on a surface of the enclosure of the printer. Typically, the ink fill ports are grouped for ergonomic access, but could alternatively be located adjacent to the internal ink tanks, or other convenient location. Color and black ink fill port hatches 202, 128 are seen in the open position, thereby revealing color and black ink adapter valves 204, 130.

Figure 3:
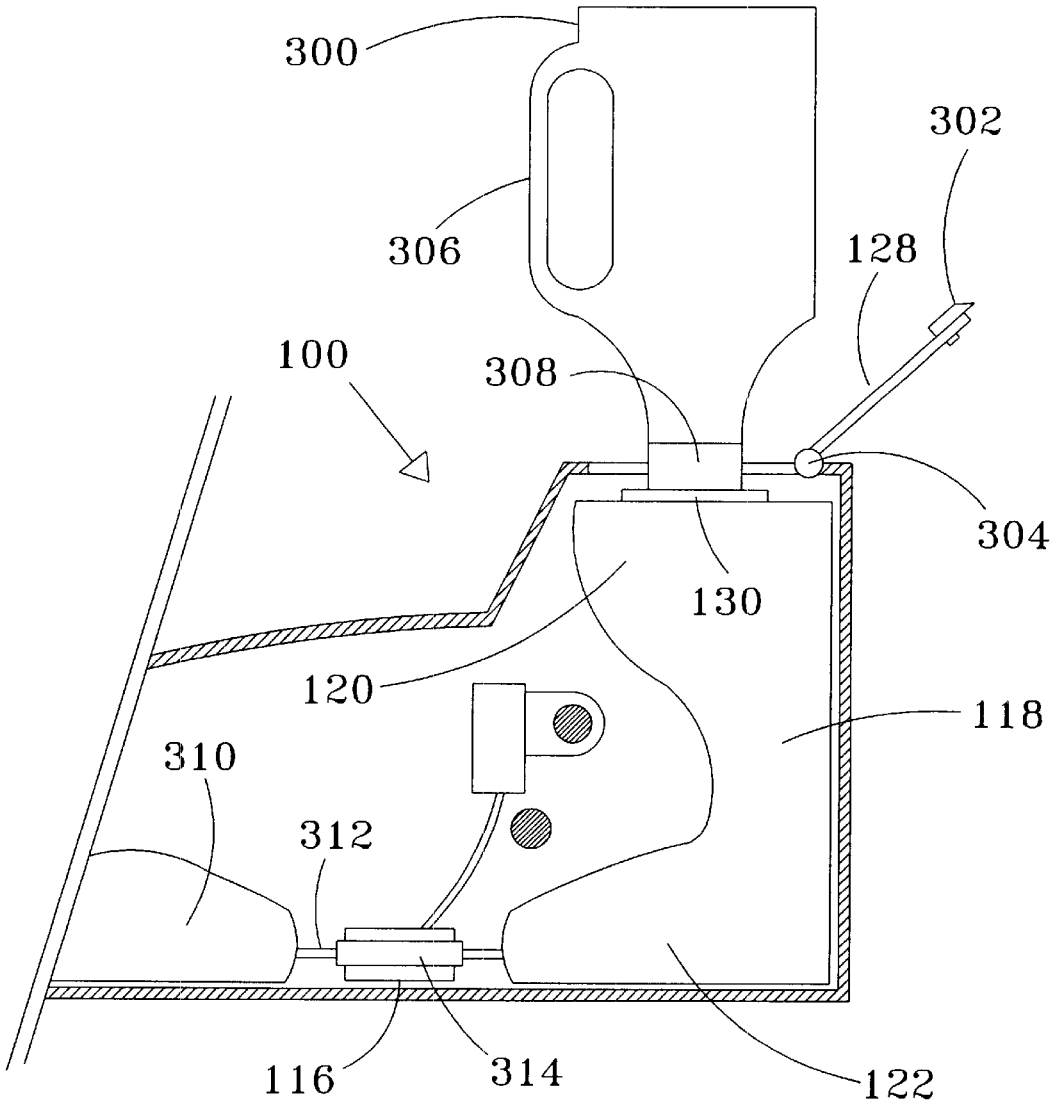
FIG. 3 is an enlarged side cross-sectional view of the printer, taken along the 3—3 lines of FIG. 2, additionally showing the use of an ergonomically shaped ink refill canister filling the internal ink tank. Double lines indicate that a front portion of the printer has been removed from the illustration for reasons of clarity and space.

FIG. 3 shows a side cross-sectional view of the printer 100, illustrating an ink delivery system that enables the internal ink tank 118 to be filled by an ergonomically shaped ink refill canister 300. The black ink fill port hatch 128 is shown the open position, the latch 302 having been released, and the hatch rotated into an open position on hinges 304 or similar pivoting means.

An implementation of the ergonomically shaped ink refill canister includes a handle 306 to allow the canister 300 to be easily manipulated. A valve 308 allows the canister to be inverted without ink discharge, and attached to the adapter 130 of the internal ink tank 118. Alternatively, the adapter 130 may be attached to a tube, which in turn is connected directly to the ink tank 118, or indirectly, through a manifold or similar structure. Where the adapter 130 contains a lid, the lid is removed. Where the adapter contains a valve, the value may be opened before or after attachment of the canister 300, depending on its structure. Following attachment of the canister, the valve 308 may be opened by rotation or other manipulation. Once the valve is opened, ink transfers from the refill canister to the internal ink tank.

An auxiliary internal ink tank 310 may be connected by a tube 312 to a manifold 314 supplying the pump 116. By connecting a primary internal ink tank to one or more auxiliary ink tanks through a manifold, the space available within the printer's enclosure may be more efficiently utilized by filling those areas best suited for ink storage (in part due to their poor suitability for other purposes) with one or more auxiliary internal ink tanks.

Figure 4:
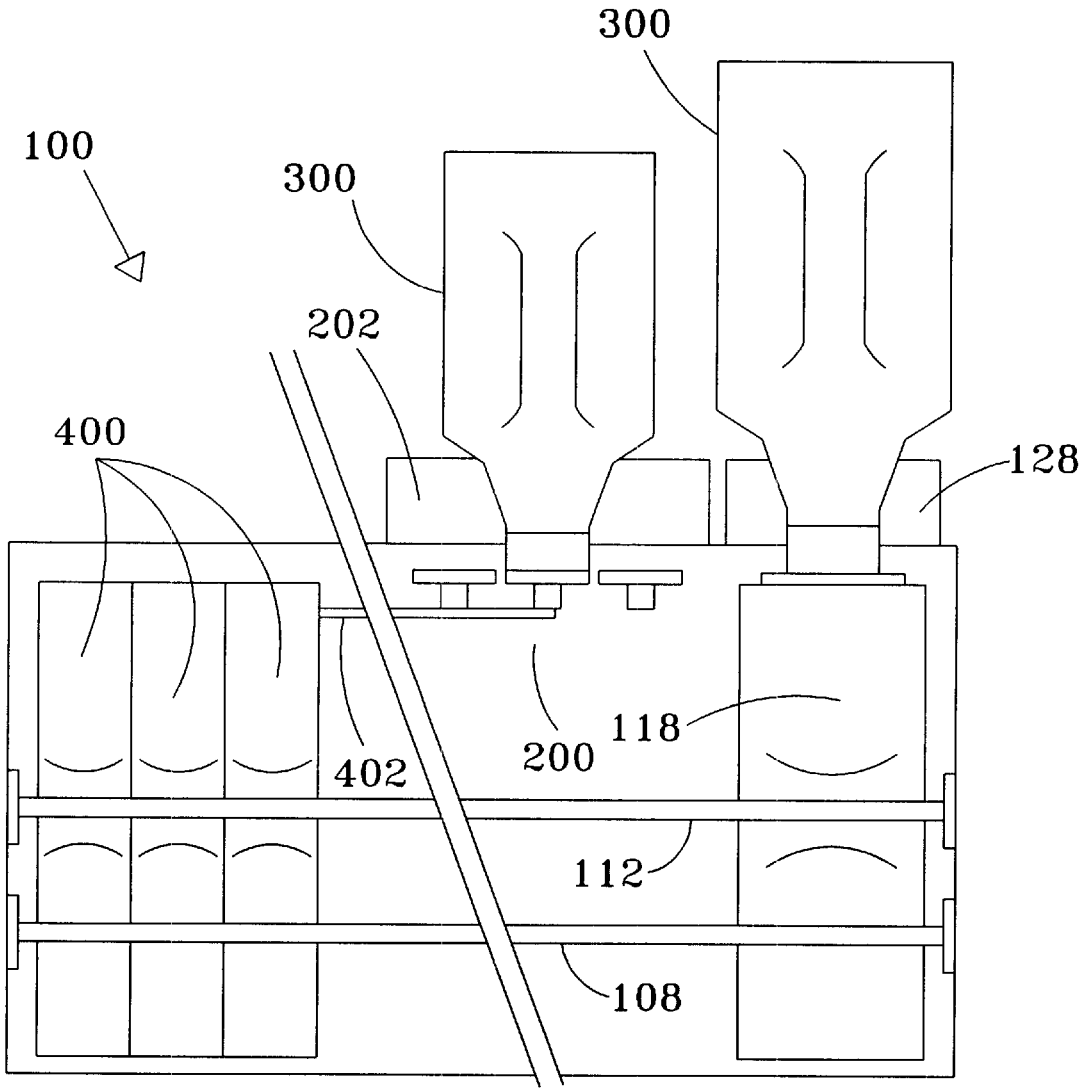

FIG. 4 shows a cross-sectional view of the printer 100 illustrating the use of ergonomically shaped ink refill canisters 300 filling one of the three internal color ink tanks 400 and the black internal ink tank 118. In an implementation wherein the internal color ink tanks 400 are not immediately adjacent to the color ink fill port 200, a tube 402 connects the color ink fill port 200 to the color ink tanks. Where a manifold is associated with one or more color or black ink tanks, the tube may be connected to the manifold.

Figure 5:
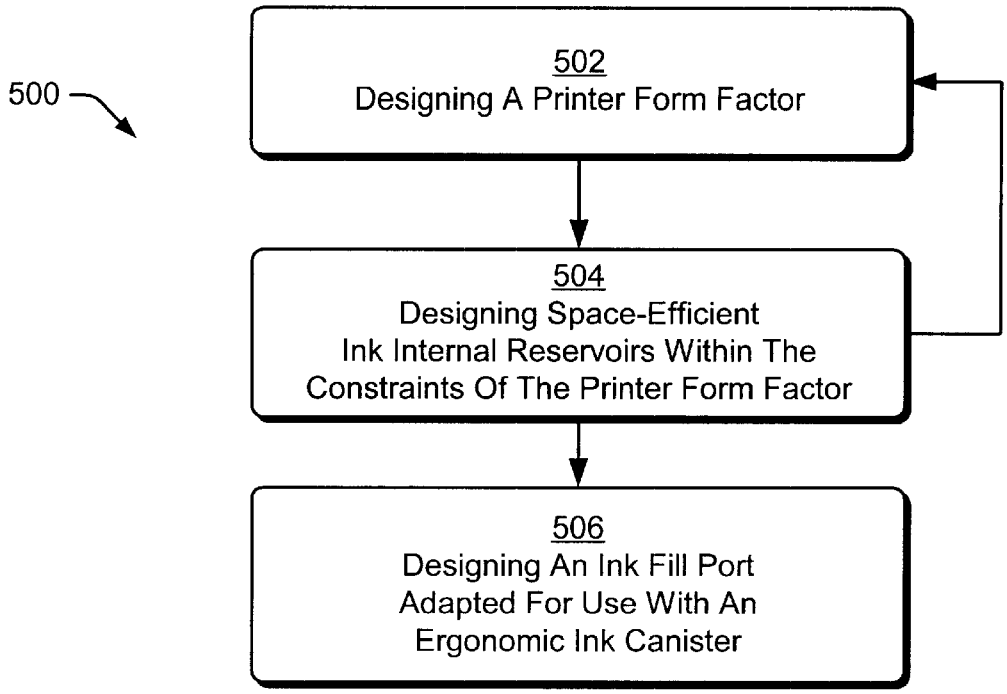
FIG. 5 is a flow diagram illustrating a method by which a printer may be designed, utilizing an ink delivery system including an internal ink tank that conforms to otherwise difficult to use space within a printer, a fill port, and an ergonomically shaped ink refill canister.

FIG. 5 shows a method 500 by which an ink delivery system for a printer may be designed. Additionally, method 500 shows how the overall size of a printer may be reduced, and how a printer having a desired size or shape may be designed. While removable ink containers are a design parameter around which conventional designs must negotiate, the method 500 overcomes this obstacle. The method 500 provides more flexibility to the designer by utilizing internal ink tanks, and a fill port—associated with each ink tank color—adapted for use with ergonomically shaped ink refill canisters. Accordingly, a more ergonomic printer enclosure may be designed, which is consistent with the mechanical needs of the printer.

At block 502, an initial desired printer enclosure size and shape, as well as an initial mechanical layout of the printer, is determined. The enclosure design is typically smaller and/or more aesthetic than prior printers having similar abilities. The enclosure design is made with regard to the mechanical apparatus and internal ink tanks to be contained within the enclosure.

At block 504, space-efficient internal tanks ink tanks 118, 400 are designed to fit within the constraints of the designed form factor, while still providing the desired ink capacity. For example, it can be seen that in the exemplary design of FIG. 3, the internal ink tank 118 has been designed to avoid space needed for the paper path, thereby fitting within the constraints of the printer's size and shape. While the space required for the paper path is avoided, the design of the shape of the internal ink container does include one or more lobes 120, 122 which extend into and occupy otherwise unused and inaccessible regions. A region may be considered to be inaccessible to use by a removable ink tank because, due to physical barriers such as paper advance mechanisms, no reasonably priced or conveniently locatable means would provide access.

Additionally, one or more auxiliary internal ink tanks 310 may be designed to fit within small areas that would otherwise not be used. Connecting tubes 312 are designed, as needed, and a optionally a manifold 314 may be designed to connect one or more internal ink tanks and/or the appropriate fill port.

In some applications, iteration between blocks 502 and 504 may be required to complete the design process.

At block 506, ink fill ports adapted for use with an ergonomic ink refill canister allow the internal ink tanks to be refilled. Where no portion of the internal ink tank is adjacent to the printer's enclosure, a tube may be designed to connect the fill port to the internal ink tank. Ergonomically shaped ink refill canisters 300 are designed to be easily held, carried and manually manipulated. A valve 308 is designed to prevent ink from spilling from the refill canister, and to allow a required volume of ink to be transferred into the internal ink tank.

Figure 6:
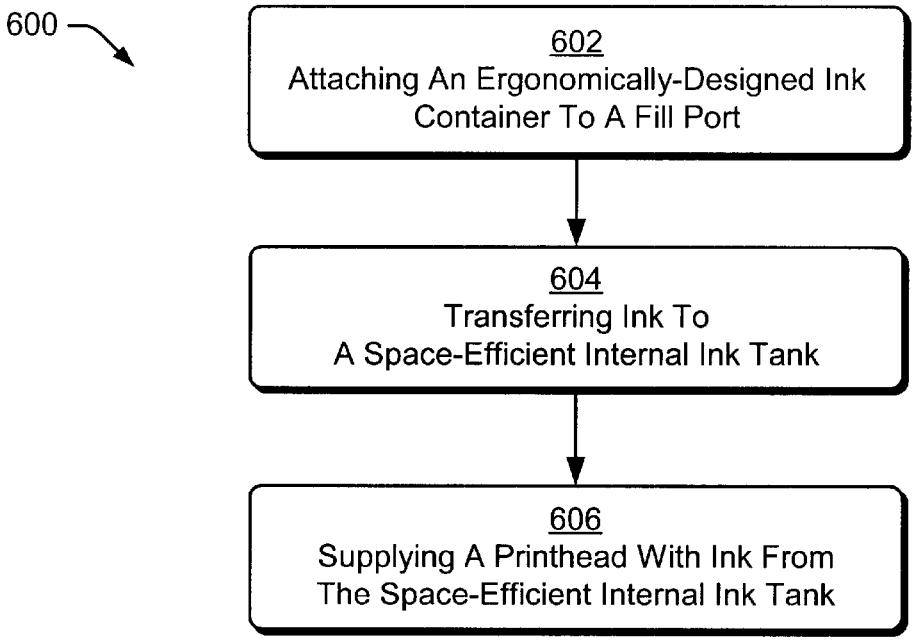
FIG. 6 is a flow diagram illustrating a method by which an ink delivery system is operated.

FIG. 6 shows a method 600 by which ink may be supplied to a printhead, particular in an environment wherein a printer 100 includes an ink delivery system having internal ink tanks 118, 400, ink fill ports 126, 200 and ergonomically shaped ink refill canisters 300.

At block 602, an ergonomically shaped ink refill canister 300 is attached to one or more fill ports 126, 200. Due to the ergonomic design of the canister 300, typically including a handle 306, the canister is easily managed. In the embodiment of FIG. 3, a valve 308 allows the canister to be inverted without ink discharge. The valve is attached to the adapter 130 of the internal ink tank 118, 400.

At block 604, the valve 308 is opened, and the ink transferred from the ergonomically shaped canister 300 to the internal ink tank 118, 400. After the ink has transferred, the canister is removed, and the adapter valve 130 and the ink port fill hatch 128 are closed. Color ink is similarly refilled.

At block 606, ink from the internal ink tank is transferred to a printhead. As seen in FIG. 1, this may be accomplished by use of a pump 116 and tube 114, which feed ink to the printhead as it is needed.

As seen above, an implementation of a printer ink delivery system and method for increasing the efficiency of space utilization within a printer includes at least one available-space-conforming internal ink tank adapted to fit within difficult to access areas within a printer's enclosure. A fill port allows the temporary attachment of an externally located, ergonomically shaped ink refill canister. Because an auxiliary tank and/or a lobes of an internal ink tank extends into space which otherwise might go unused, a smaller printer enclosure may be designed. By providing a fill port adapted for attachment of ergonomically shaped ink refill canister, the user is easily able to refill the internal ink tank.

Although the disclosure has been described in language specific to structural features and/or methodological steps, it is to be understood that the appended claims are not limited to the specific features or steps described. Rather, the specific features and steps are exemplary forms of implementing this disclosure. For example, while an exemplary internal ink tank, fill port and ergonomically shaped ink refill tank has been disclosed, the dimensions, appearance and details of these elements could be adapted to fit any desired printer size, shape or configuration.

What is claimed is:

1. An ink delivery system for a printer, comprising:

an internal ink tank, carried within a printer enclosure, the internal ink tank comprising at least one lobe extending into and occupying an otherwise unused region within the printer enclosure; and a fill port, in communication with the internal ink tank.

2. The ink delivery system of claim 1, additionally comprising:

an ink refill canister, adapted for attachment to the fill port.

3. The ink delivery system of claim 2, additionally comprising:

a plurality of internal color ink tanks to contain color ink; and a color ink fill port, in communication with the internal color ink tanks.

4. The ink delivery system of claim 3, additionally comprising:

a pump to deliver ink from the internal ink tank to a printhead.

5. The ink delivery system of claim 4, additionally comprising:

an auxiliary internal ink tank, in communication with the internal ink tank.

6. The ink delivery system of claim 5, additionally comprising:

a manifold, connected to the internal ink tank, the auxiliary internal ink tank and the fill port.

7. The ink delivery system of claim 1, additionally comprising:

a plurality of internal color ink tanks to contain color ink; and a color ink fill port, in communication with the internal color ink tanks.

8. The ink delivery system of claim 1, additionally comprising:

a pump to deliver ink from the internal ink tank to a printhead.

9. The ink delivery system of claim 1, additionally comprising:

an auxiliary internal ink tank, in communication with the internal ink tank.

10. The ink delivery system of claim 9, additionally comprising:

a manifold, connected to the internal ink tank, the auxiliary internal ink tank and the fill port.

11. An ink storage system for a printer, comprising:

an internal ink tank carried within a printer enclosure comprising first and second lobes, each lobe extending into and occupying an otherwise unused region within the printer enclosure, wherein the first and second lobes are connected by an isthmus;

a first fill port, in communication with the internal ink tank;

an ink refill canister, adapted for attachment to the first fill port;

a plurality of internal color ink tanks associated with color ink carried within the printer enclosure having at least one lobe extending into and occupying an otherwise unused region within the printer enclosure;

a second fill port, in communication with the internal color ink tanks; and an ink refill canister, adapted for attachment to the second fill port.

12. A method of designing an ink delivery system for a printer, comprising:

determining a size and shape of a printer enclosure; and designing an internal ink tank within the printer enclosure, wherein the internal ink tank comprises first and second lobes connected by an isthmus, wherein the first and second lobes are located to reduce an overall size of the printer enclosure.

13. The method of claim 12, additionally comprising:

designing at least one auxiliary internal ink tank within the printer enclosure in communication with the internal ink tank.

14. The method of claim 12, additionally comprising:

designing an ink fill port, in communication with the internal ink tank.

15. The method of claim 14, additionally comprising:

designing an ergonomic ink refill canister, adapted for attachment to the ink fill port.

16. A method of supplying ink, comprising:

attaching an ink refill canister to a fill port of a printer;

transferring ink from the ink refill canister into an internal ink tank, wherein the ink fills portions of the internal ink tank comprising at least two lobes connected by an isthmus; and removing the ink refill canister.

17. The method of supplying ink of claim 16, additionally comprising:

transferring ink from the internal ink tank to a printhead.

18. The method of supplying ink of claim 16, additionally comprising:

attaching a color ink refill canister to a color ink fill port of the printer;

transferring color ink into an internal color ink tank; and removing the color ink refill canister.

19. The method of supplying ink of claim 16, additionally comprising:

filling an auxiliary internal ink tank with ink.

* * * * *